US009149677B2

(12) United States Patent
Rountree et al.

(10) Patent No.: US 9,149,677 B2
(45) Date of Patent: Oct. 6, 2015

(54) REMOVABLY MOUNTED EXERCISE STATION

(75) Inventors: Richard Villagonzalo-Moby Rountree, Beverly Hills, CA (US); Josue Jeffrey Sandoval, Culver City, CA (US)

(73) Assignee: LIMITLESS WELLNESS PROJECT LLC, Beverly Hills, CA (US)

( * ) Notice: Subject to any disclaimer, the term of this patent is extended or adjusted under 35 U.S.C. 154(b) by 142 days.

(21) Appl. No.: 13/485,499

(22) Filed: May 31, 2012

(65) Prior Publication Data

US 2013/0324378 A1 Dec. 5, 2013

(51) Int. Cl.

| | |
|---|---|
| ***A63B 21/04*** | (2006.01) |
| ***A63B 21/02*** | (2006.01) |
| ***A63B 21/055*** | (2006.01) |
| ***A63B 21/16*** | (2006.01) |
| ***A63B 23/035*** | (2006.01) |
| *A63B 21/00* | (2006.01) |

(52) U.S. Cl.

CPC ..... *A63B 21/0442* (2013.01); *A63B 21/0552* (2013.01); *A63B 21/1645* (2013.01); *A63B 23/0355* (2013.01); *A63B 21/1403* (2013.01); *A63B 2210/50* (2013.01)

(58) Field of Classification Search

CPC .. A63B 21/00; A63B 21/00061; A63B 21/02; A63B 21/04; A63B 21/0442; A63B 21/044; A63B 21/0555; A63B 21/0557; A63B 21/08; A63B 21/16; A63B 21/1645

USPC ..... 482/92, 121–123, 126, 129, 130

See application file for complete search history.

(56) References Cited

U.S. PATENT DOCUMENTS

| | | | | | |
|---|---|---|---|---|---|
| 680,556 | A * | 8/1901 | Wieland | 482/129 |
| 774,738 | A * | 11/1904 | Chavez | 482/92 |
| 3,618,942 | A * | 11/1971 | Bates et al. | 482/129 |
| 5,362,295 | A * | 11/1994 | Nurge | 482/124 |
| 5,626,546 | A | 5/1997 | Little | 482/129 |
| 5,766,118 | A | 6/1998 | Conner | 482/129 |
| 6,267,711 | B1 * | 7/2001 | Hinds | 482/121 |
| 6,322,483 | B1 * | 11/2001 | Rotella | 482/129 |
| 6,494,817 | B2 * | 12/2002 | Lake | 482/93 |
| 6,607,472 | B2 * | 8/2003 | Toole | 482/123 |
| 6,908,418 | B2 * | 6/2005 | Saure | 482/121 |
| 6,941,620 | B1 * | 9/2005 | Hinds | 24/134 R |
| 7,322,909 | B1 * | 1/2008 | Loccarini et al. | 482/129 |
| 7,976,445 | B2 * | 7/2011 | Lalaoua | 482/129 |
| 8,057,370 | B2 * | 11/2011 | Dunn | 482/121 |
| 8,821,359 | B1 * | 9/2014 | Kassel | 482/121 |
| 2003/0158024 | A1 * | 8/2003 | Saure | 482/126 |
| 2003/0186792 | A1 * | 10/2003 | Keeler | 482/129 |
| 2004/0087420 | A1 * | 5/2004 | Montesquieux | 482/129 |
| 2004/0185990 | A1 * | 9/2004 | Orescan et al. | 482/126 |
| 2006/0084556 | A1 | 4/2006 | Payne | 482/121 |
| 2008/0300118 | A1 * | 12/2008 | Wehrell | 482/129 |
| 2010/0048368 | A1 | 2/2010 | Donofrio | |

(Continued)

*Primary Examiner* — Stephen Crow
*Assistant Examiner* — Garrett Atkinson
(74) *Attorney, Agent, or Firm* — DLA Piper LLP (US)

(57) ABSTRACT

A removably mounted exercise station includes an elongated anchoring member disposed on a first surface of an external stationary object, such as a door. The anchoring member has a plurality of apertures and rails formed between the apertures. A securing strap wraps around a second surface of the external stationary object to secure the exercise station onto the external stationary object. A resistance band connects to one of the rails to provide resistance during an exercise routine. A clamp allows for quick connect and disconnect of the resistance band to the rails.

7 Claims, 5 Drawing Sheets

(56) References Cited

U.S. PATENT DOCUMENTS

| | | | | |
|---|---|---|---|---|
| 2011/0195822 | A1 | 8/2011 | Donofrio | |
| 2011/0195825 | A1* | 8/2011 | Liester | 482/120 |
| 2011/0237410 | A1 | 9/2011 | Perez | |
| 2012/0129663 | A1 | 5/2012 | Dunn | |
| 2012/0202656 | A1* | 8/2012 | Dorsay | 482/121 |
| 2012/0220435 | A1* | 8/2012 | Sweeney | 482/121 |
| 2013/0337983 | A1* | 12/2013 | McTavish | 482/139 |
| 2014/0031182 | A1* | 1/2014 | Donofrio | 482/129 |

* cited by examiner

REMOVABLY MOUNTED EXERCISE STATION

BACKGROUND OF THE INVENTION

This invention relates to exercise equipment and, in particular, relates to a removably mounted exercise station that enables users to use resistance bands at various positions on the station. Further, a suspension strap may be connected to the station as well.

DESCRIPTION OF RELATED ART

Recently, exercise devices mounted on a door utilizing resistance bands have been developed. Resistance bands are low cost, portable, and easy-to-use options for exercise.

Exercise stations may fasten resistance bands to doors through use of nylon straps and clamps. US 2006/0084556 describes use of an anchoring strap to secure the exercise apparatus to either a door frame or to another immovable object. U.S. Pat. No. 5,766,118 describes attachment of a device to a door with a clamp that is fastened to the top of the door. U.S. Pat. No. 6,322,483 discloses a resistance band adjustable strap that loops vertically around a door. On one side of the strap are a series of loops running from the floor to the top of the door. Resistance bands are slipped through the strap loops. U.S. Pat. No. 6,908,418 describes use of a door mounted strap and tension-locking clamp to secure a band vertically around a door. These devices are based on nylon straps.

Another type of device uses a rail system to adjust position. For example, U.S. Pat. No. 5,626,546 describes a rail system that employs a vertically sliding "wall mount channel" that can be locked in place.

BRIEF DESCRIPTION OF THE DRAWINGS

FIG. 2(*b*) is a perspective view from the rear of the door showing the elongated anchoring member of FIG. 2(*a*) anchored to the door.

DETAILED DESCRIPTION OF THE INVENTION

Figure 1:
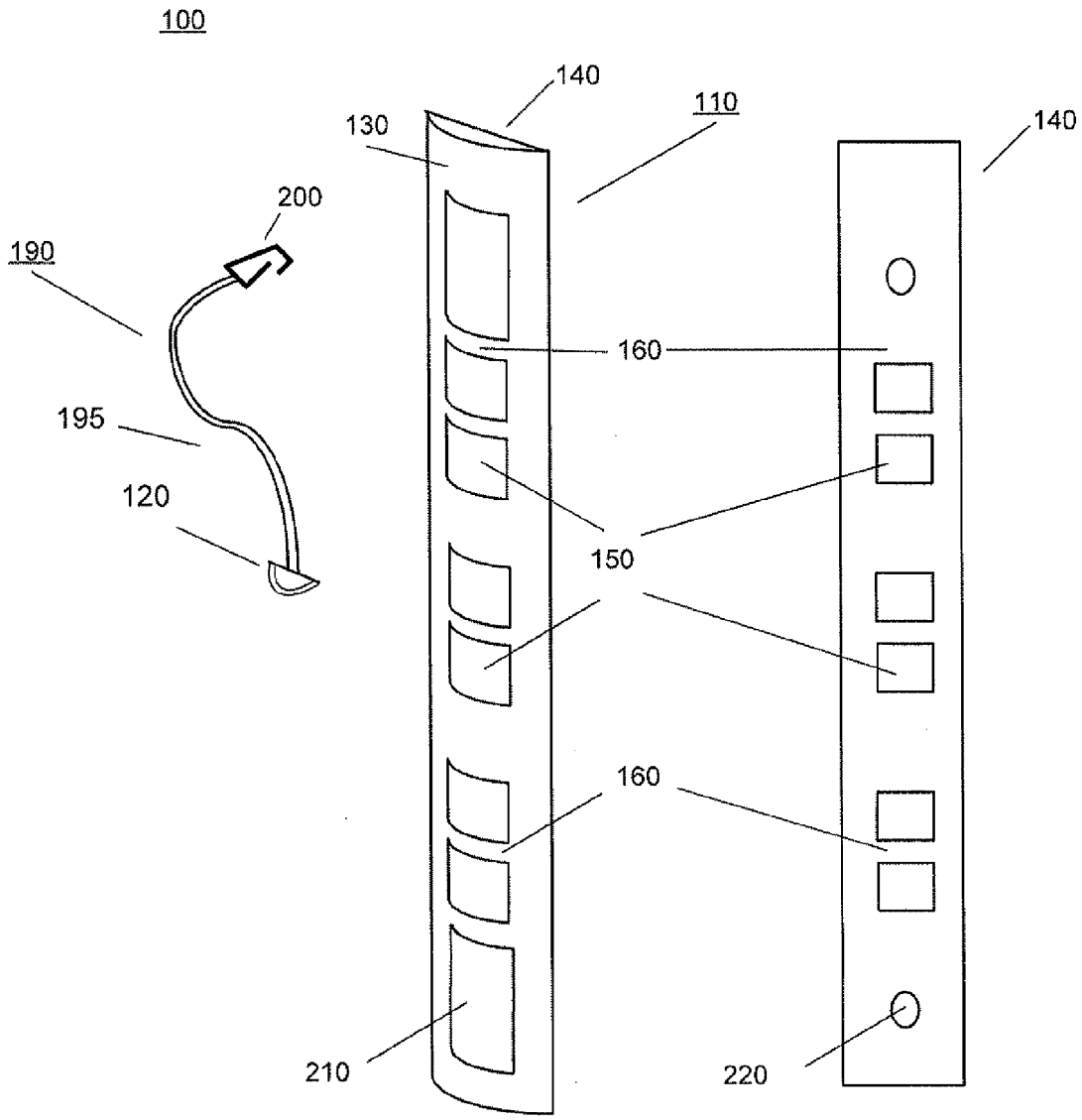
FIG. 1 illustrates front and rear views of a removable mounted exercise station according to the present invention.
Figure 2A:
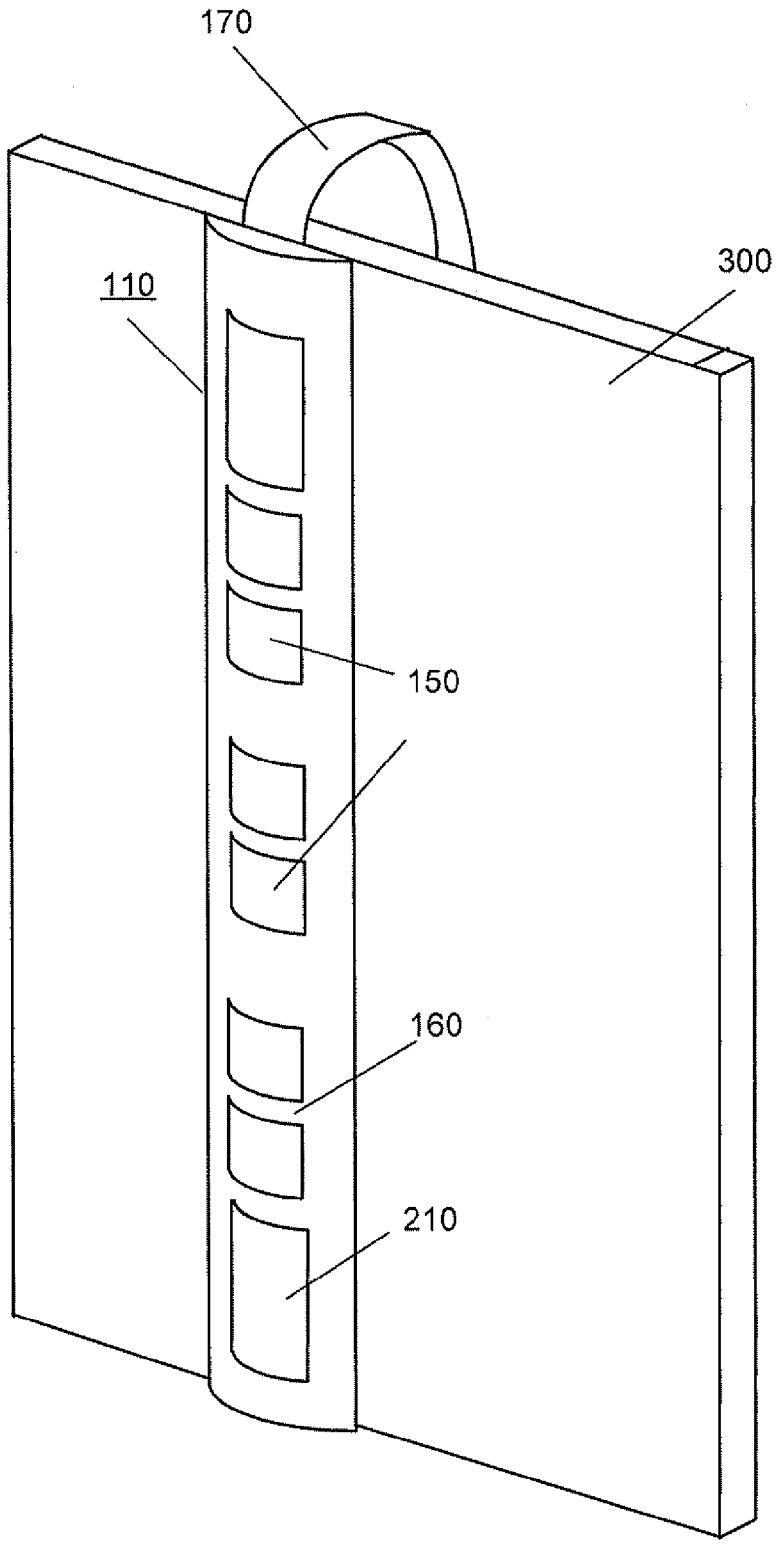
FIG. 2(*a*) is a perspective view from the front of a door showing an elongated anchoring member according to the present invention anchored to the door.
Figure 2B:
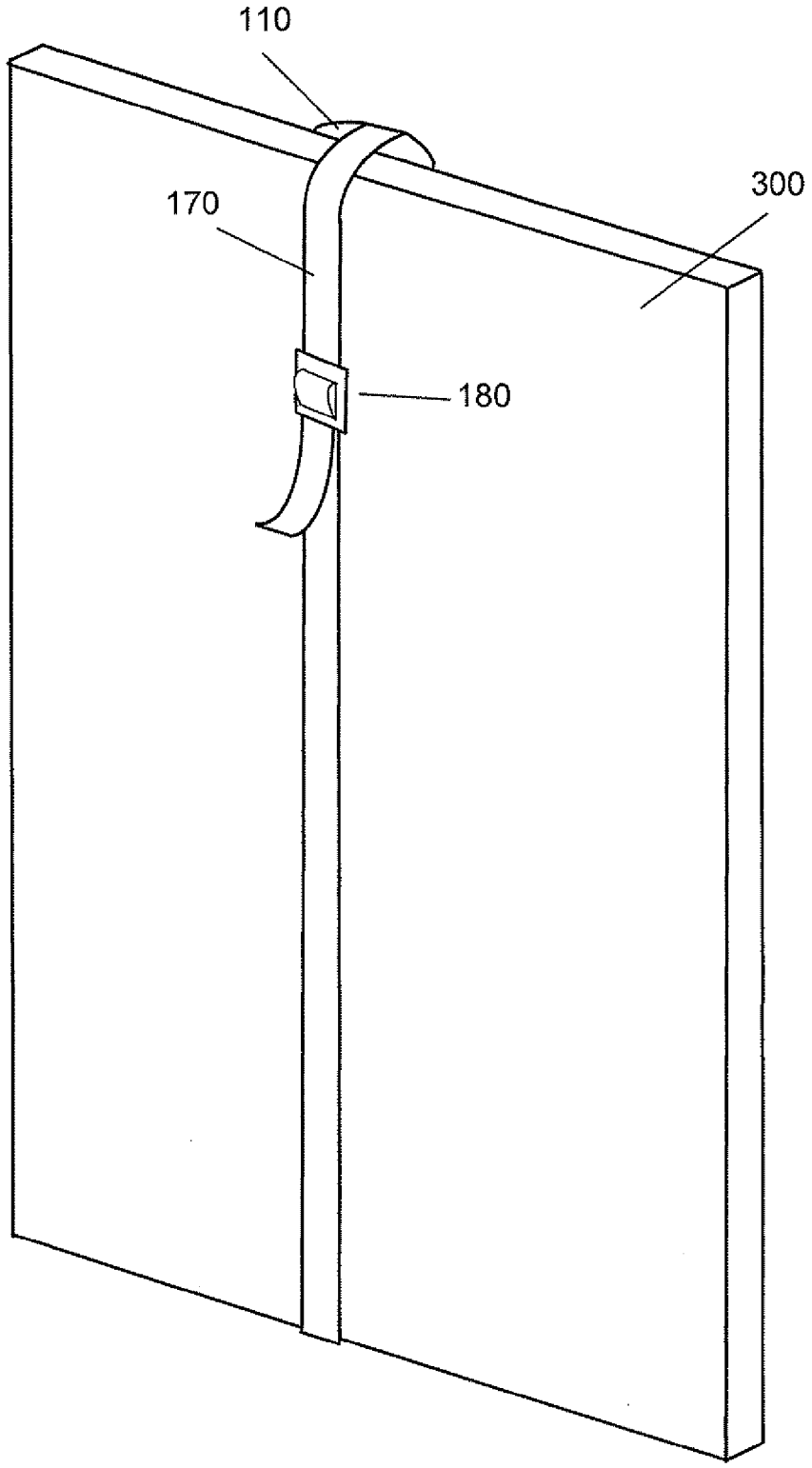

FIG. 1 shows removable mounted exercise station 100 according to a first embodiment of the present invention. Exercise station 100 includes elongated anchoring member 110 and resistance band 190. As shown in FIGS. 2(*a*) and 2(*b*), exercise station 100 may be mounted or secured onto a door 300 (an example of an external stationary object).

Elongated anchoring member 110 may take various shapes and forms. In this example, elongated anchoring member 110 is an elongated hollow tube having front and slightly curved surface 130, and rear surface 140. Elongated anchoring member 110 may be made of, for example, metal such as stainless steel or other rigid materials of sufficient rigidity to withstand stress applied by a user.

Apertures 150 are formed on front surface 130 of elongated anchoring member 110, forming rails 160 thereon. Rails 160 are configured to allow clamps to be quickly attached and detached thereon.

Figure 4:
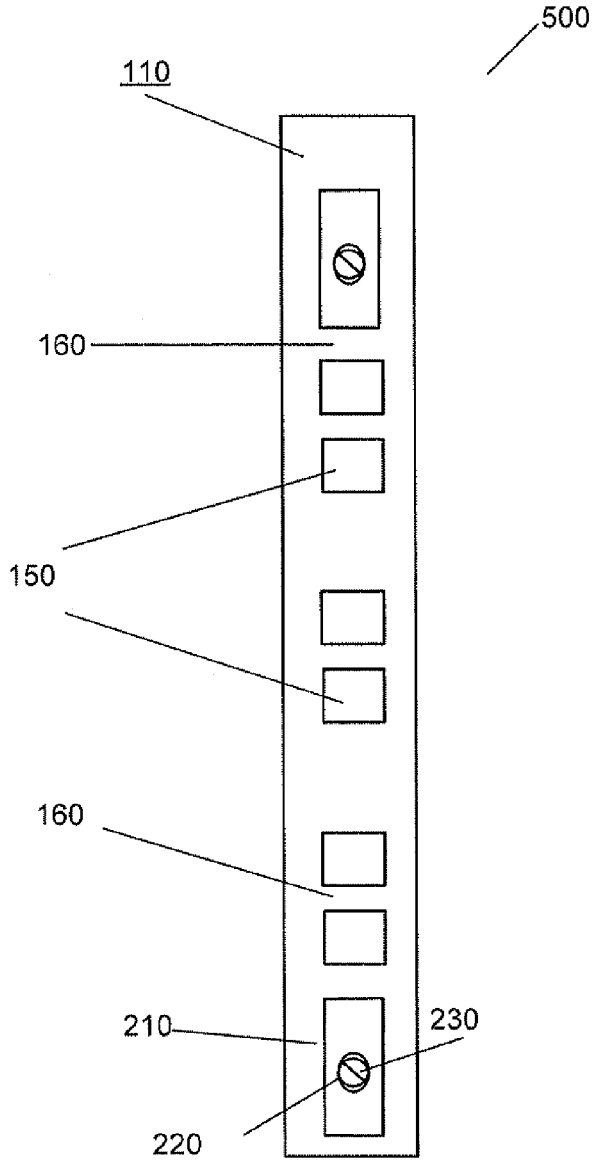
FIG. 4 is a front view showing the elongated anchoring member of the present invention anchored to a wall.

Front surface 130 further includes permanent mounting opening 210. Rear surface 140 includes permanent screw hole 220. As shown in FIG. 4, a screw may be placed through permanent mounting opening 210 and permanent screw hole 220 to mount removable mounted exercise station 100 on a more permanent basis.

Elongated anchoring member 110 may also include a plurality of portions connected by hinges. This configuration allows a user to fold the rigid member when not in use, thereby saving storage space.

FIGS. 2(*a*) and 2(*b*) show exercise station 100 secured or anchored onto door 300. FIG. 2(*a*) is a perspective view from the front of the door, and FIG. 2(*b*) is a perspective view from the rear of the door.

Securing strap 170 attaches to the top and bottom ends of elongated anchoring member 110, and wraps around door 300. Securing strap 170 includes ratchet system 180 that allows tightening of the attachment to door 300 by adjusting the tension of securing strap 170. Alternatively, in place of ratchet system 180, a buckle may be used to adjust the tension of securing strap 170.

Resistance band 190 (FIG. 1) is connectable to one of the rails 160 on elongated anchoring member 110. Resistance band 190 includes clamp 200 at one end of resistance line 195 that clamps or hooks to rail 160 in order to attach band 190 to anchoring member 110. A commercially available clamp such as a snap link hook carabiner, commonly used in outdoor gear, is one example of a suitable clamp.

Resistance band 190 also includes handle 120 at an end of resistance line 195 opposite clamp 200. In one embodiment, handle 120 may be removably connected to resistance line 195 via a D-ring and snap link hook carabiner to allow for a quick change of handles. Many types of handles are suitable for handle 120. Alternatively, a body harness may be used instead of a handle to allow for additional exercises. Resistance line 195 may be formed of rubber or plastic to provide resistance for exercise. Resistance band 190 may include a plurality of resistance lines 195 connected to a single handle 120.

Multiple resistance bands 190 may be connected to multiple rails 160 at desired positions. For example resistance band 190 of a first resistance may be connected at a high position on anchoring member 110 for arm exercises, and resistance band 190 of a second resistance may be connected at a low position on anchoring member 110 for leg exercises. Thus, a user may perform multiple exercises at the same time. The system of clamps and rails allow a user to quickly and easily change the position of resistance bands 190.

A suspension strap may be connected via a clamp to rail 160 at or near the top of elongated anchoring member 110 to allow a user the additional exercise of suspension from removable mounted exercise station 100.

Figure 3:
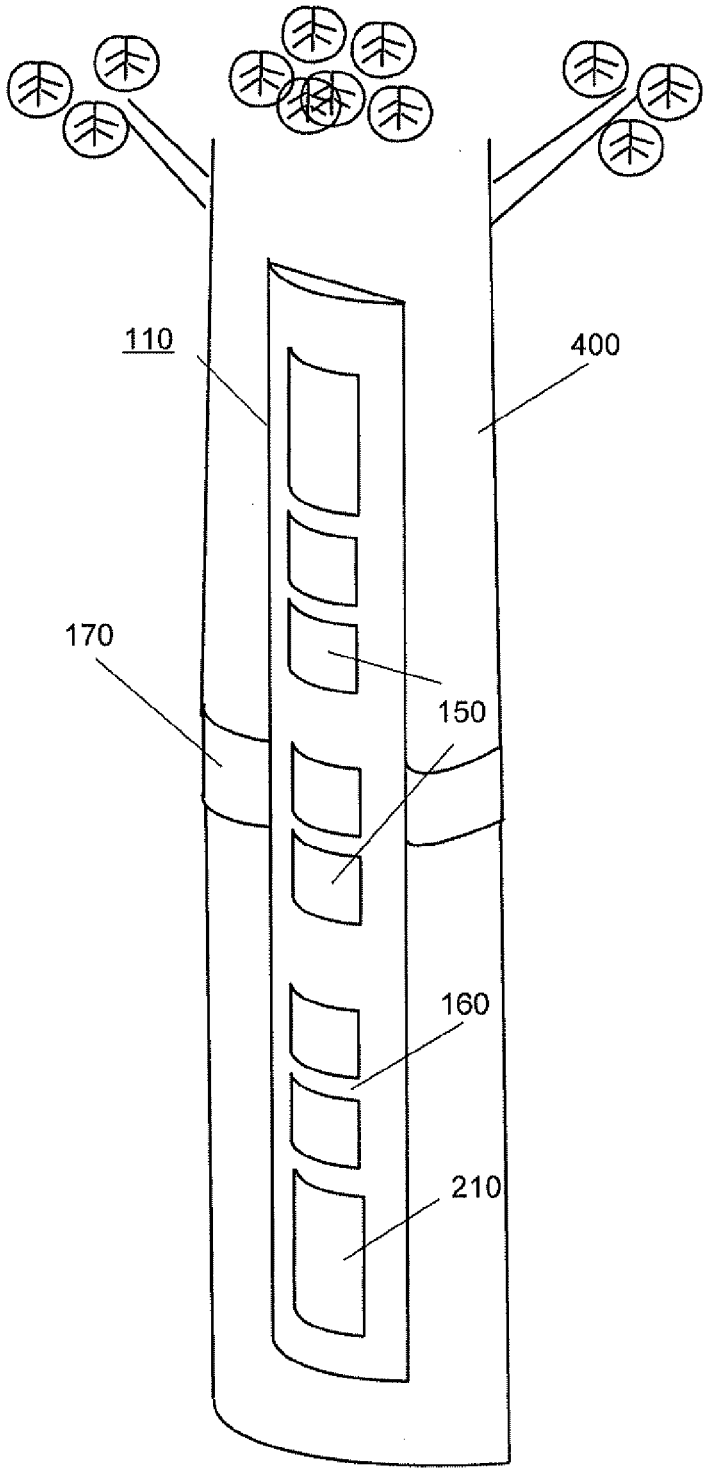
FIG. 3 is a front view showing the elongated anchoring member of the present invention anchored to a tree.

FIG. 3 shows removable mounted exercise station 100 according to a second embodiment of the present invention mounted or secured onto tree 400 (an example of an external stationary object). In this embodiment, securing straps 170 are wrapped around tree 400. That is, securing strap 170 extends horizontally from elongated anchoring member 110 and wraps around tree 400. A ratchet system may be used as previously described to tighten securing strap 170 around tree 400.

FIG. 4 depicts a third embodiment in which exercise station 100 is anchored to a wall 500 on a more permanent basis.

As discussed above, front surface 130 of elongated anchoring member 110 includes permanent mounting opening 210, and rear surface 140 includes permanent screw hole 220. Permanent mounting opening 210 and permanent screw hole 220 are examples of wall mount portions. Screw 230 is placed through permanent mounting opening 210 and permanent screw hole 220 to secure elongated anchoring member 110 onto wall 500.

Many modifications and variations of the present invention are possible in light of the above teaching. Accordingly, the scope of the appended claims embraces such modifications and variations.

The invention claimed is:

1. A removably mountable exercise station comprising:

a tubular, rigid, elongated anchoring member configured to be disposed on a first surface of an external stationary object, the elongated anchoring member comprising a continuously curved front surface and a flat rear surface having a plurality of apertures and rails formed between the apertures; and a resistance band removably attachable to the rails on the elongated anchoring member, wherein the resistance band includes a clamp configured to be quickly attached to and detached from the rails; and a securing strap orientable on said member vertically or horizontally and adapted to removably connect said anchoring member to the external stationary object.

2. The removably mountable exercise station according to claim 1, wherein a first end of the securing strap is affixed to a first end of the elongated anchoring member and a second end of securing strap is affixed to a second end of the elongated anchoring member, and the securing strap is configured to be disposed on a second surface of the stationary object, such that the elongated anchoring member and the securing strap are secured onto the external stationary object.

3. The removably mountable exercise station according to claim 1, wherein the elongated anchoring member is formed of metal.

4. The removably mountable exercise station according to claim 1, wherein a mounting opening is formed in the curved front surface, and a screw hole is formed in the rear surface, such that a screw may be placed through the mounting opening and screw hole to secure the elongated anchoring member to a wall.

5. The removably mountable exercise station according to claim 1, wherein the securing strap includes a ratchet system configured to tighten a tension on the securing strap.

6. The removably mountable exercise station according to claim 1, wherein the securing strap includes a buckle configured to tighten a tension on the securing strap.

7. The removably mountable exercise station according to claim 1, wherein the elongated anchoring member further includes a wall mount portion.

* * * * *